US006070828A

United States Patent [19]

Ishida

[11] Patent Number: 6,070,828

[45] Date of Patent: Jun. 6, 2000

[54] CURL REMOVING DEVICE FOR ROLLED PAPER UTILIZABLE IN IMAGE FORMING APPARATUS

[75] Inventor: Kazuhito Ishida, Ichinomiya, Japan

[73] Assignee: Brother Kogyo Kabushiki Kaisha, Nagoya, Japan

[21] Appl. No.: 09/210,580

[22] Filed: Dec. 14, 1998

Related U.S. Application Data

[62] Division of application No. 08/883,103, Jun. 26, 1997, Pat. No. 5,881,966.

[30] Foreign Application Priority Data

| | | | |
|---|---|---|---|
| Jun. 28, 1996 | [JP] | Japan | 8-169362 |
| Jul. 23, 1996 | [JP] | Japan | 8-193780 |
| Jul. 23, 1996 | [JP] | Japan | 8-193781 |

[51] Int. Cl.[7] ..... B65H 23/00; B65H 23/32

[52] U.S. Cl. ..... 242/566; 242/615.21; 101/228; 346/146

[58] Field of Search ..... 242/566, 615.21, 242/548; 346/146; 101/228, 219

[56] References Cited

FOREIGN PATENT DOCUMENTS 5-238617 9/1993 Japan .

*Primary Examiner*—John Q. Nguyen
*Attorney, Agent, or Firm*—Oliff & Berridge, PLC

[57] ABSTRACT

A curl removing device utilizable for the facsimile machine (1), in which the cutout portion (31) is formed on the holding part (28) of the curl removing plate (14) and it is formed in the plate holding part (13) the resilient hook member (24) which positions the curl removing plate (14) against the flat plate part (20) by being resiliently hooked to the cutout portion (31), and when the curl removing plate (14) is installed to the plate holding part (13), the curl removing plate (14) is slid on the flat plate part (20) so that the support shafts (22) of the support sections (21) are inserted in the support holes (30) of the support parts (29) in one direction (the direction shown by the arrow C) and the resilient hook member (24) is hooked to the cutout portion (31).

16 Claims, 9 Drawing Sheets

CURL REMOVING DEVICE FOR ROLLED PAPER UTILIZABLE IN IMAGE FORMING APPARATUS

This is a Division of application Ser. No. 08/883,103 filed Jun. 26, 1997, U.S. Pat. No. 5,881,966. The entire disclosure of the prior application is hereby incorporated by reference herein in its entirety.

BACKGROUND OF THE INVENTION

1. Field of the Invention

The present invention relates to a curl removing device for removing a curl from a rolled paper by straining in a direction opposite to a curl direction thereof when deriving the rolled paper from a tray formed in an image forming apparatus such as facsimile machine which utilizes as a print paper the rolled paper in a roll form. In particular, the present invention relates to a curl removing device in which a curl removing plate used therein can be very easily installed in a main body of the image forming apparatus, thereby assembling work thereof can be easily done by simplifying assembling steps.

And the present invention relates to the curl removing device of the rolled paper in which number of parts can be reduced and easily assembled, thereby the cost thereof can be lowered. Further, the present invention relates to the curl removing device of the rolled paper in which clearance among the parts thereof can vanish, thereby uncomfortable noise due to the clearance can be avoided and it can prevent the parts from being broken due to the clearance.

2. Description of Related Art

In general, in the facsimile machine utilizing as the print paper the rolled paper which is rolled around a cylindrical core in a roll form, the curl inevitably occurs in the rolled paper derived from the core, and in case that the curl is not removed from the paper, the paper which is discharged from the facsimile machine after characters transmitted from the other facsimile machine are printed is inevitably curled, thus handling of the received papers becomes very troublesome. To dissolve this problem, it is conventionally proposed various devices for removing the curl from the rolled paper.

For instance, it is disclosed in Japanese Patent Application, Laid Open No. Hei 5-238,617, a curl removing device in which a curl removing plate is fixed on a flange of upper cover in the facsimile machine by screws. In the curl removing device, the rolled paper derived from a tray is strained in a direction opposite to the curl direction thereof through cooperation between the nose part of curl removing plate and the guide bar arranged near the nose part, thereby the curl in the rolled paper is removed.

In the curl removing device disclosed in the above Japanese Patent Application, the curl removing plate is fixed on the flange of upper cover by the screws. In this way, if the curl removing plate is fixed by the screws, fixing work of the curl removing plate to the upper cover becomes very troublesome, therefore assembling work of the curl removing device cannot be easily done.

Thus, in order that assembling of the curl removing plate inside a main body of the facsimile machine can be simply conducted, there exists, for example, a curl removing device shown in FIGS. 9 and 10. Here, it will be described based on FIGS. 9 and 10 the conventional curl removing device in which the curl removing plate can be simply assembled. FIG. 9 is a perspective view schematically showing a relation between the curl removing plate and the plate holding part in the conventional curl removing device. And FIG. 10 is a perspective view schematically showing a state that the curl removing plate is assembled to the plate holding part.

In FIGS. 9 and 10, the plate holding part 100 is formed in the facsimile machine and a pair of holding sections 101 are formed on the plate holding part 100. In each holding section 101, at the same side plane (in FIGS. 9. 10, the right side plane), a support shaft 102 is formed into one body. And a flat plate part 103 is positioned between the holding sections 101. The curl removing plate 104 is formed so as to have a curl removing part 105 having a folded top portion contacting with the rolled paper for removing the curl from the rolled paper by straining the paper in a direction opposite to the curl direction, and a holder part 106 continuously formed from the curl removing part 105 with a predetermined angle and a pair of supporting parts 108 which are formed at both side ends of the curl removing part 105 so as to be positioned at both sides of the holder part 106 and have supporting holes 107 respectively.

When the curl removing device is assembled by installing the curl removing plate 104 to the plate holding part 100, the holder part 106 is slid in the left direction on the flat plate part 103 and each support shaft 102 on the holding section 101 in the plate holding part 100 is fit into the supporting hole 107 formed in each supporting part 108 in the curl removing plate 104. Further, in order not to be produced the clearance in the lateral direction (in FIGS. 9 and 10, the clearance toward the right and left directions) due to that the supporting parts 108 moves along the support shafts 102 while the curl removing plate 104 rotates, the E-ring 109 is set to one of the support shafts 102 and thereby it is prevented the clearance between the holding section 101 and the supporting part 108 from producing. According to the above, the curl removing device shown in FIG. 10 is assembled. In the thus assembled curl removing device, it is not necessary to fasten the curl removing plate 104 by the screws, different from the curl removing device disclosed in Japanese Patent Application explained above, and the curl removing plate 104 can be comparatively easily assembled to the plate holding part 100.

However, in the curl removing device shown in FIGS. 9 and 10, it is utilized the E-ring 109 to vanish the clearance produced due to movement of each supporting part 108 in the curl removing plate 104 along the support shaft 102. At this time, it is necessary to conduct setting work of the E-ring 109 to the support shaft 102 within very narrow space and to use special jig for the E-ring 109. Therefore, setting work of the E-ring 109 to the support shaft 102 is very troublesome and difficult.

Further, in the above curl removing device, though assembling of the curl removing plate 104 to the plate holding part 100 is comparative easily done, it is necessary to set the E-ring 109 to the support shaft 102, thus number of assembling steps increases due to setting work of the E-ring 109 and assembling cost of the curl removing device is increased.

Next, another conventional curl removing device will be described with reference to FIG. 11. FIG. 11 is a side sectional view partially showing the curl removing device which is enlarged. The curl removing device 140 is utilized for the facsimile machine.

In the curl removing device 140, a bearing member 142 having an elliptical hole 142A is formed on lower surface of a upper cover 141 and a round shaft 143 made of iron is inserted in the bearing member 142. When the upper cover 141 is rotated around a rotating shaft 144 in the direction that the upper cover 141 covers upper space of a platen 145 and a recording head 146, that is, in the direction shown by an arrow C in FIG. 11, the shaft 143 is moved in the right direction in FIG. 11 within the hole 142A of the bearing member 142 by means of a shaft catch member 148 which is arranged to a print frame 147 and has a guide surface inclined in the right lower direction. Finally, the shaft 143 is caught in a catch groove of the shaft catch member 148 while the shaft 143 is faced to a curl removing plate 149 installed to the print frame 147, as shown in FIG. 11. The folded portion 149A of the curl removing plate 149 is arranged so as to face toward a rolled paper 150 and the shaft 143 caught by the shaft catch member 148 is arranged close against the curl removing plate 149, thereby it is formed a feeding path of the rolled paper 150, the feeding path being bent in the direction opposite to the curl direction of the rolled paper 150. Thus, when the rolled paper 150 derived from a tray 151 is passed through the feeding path, the curl of the rolled paper 150 is removed.

However, in the above curl removing device 140, to form the bent path in the direction opposite to the curl direction of the rolled paper 150, many parts such as the upper cover 141, the bearing member 142, the shaft 143, the shaft catch member 148 and the curl removing plate 149 are necessitated. Thus, there is a problem that assembling steps and parts for the curl removing device increase and the cost thereof also increases. And steps for inserting the shaft 143 into the bearing member 142 formed in the upper cover 141 and fixing the shaft 143 in the bearing member 142 so as not to come off by, for example, a stop ring are very troublesome, thereby it concludes to take a considerable long time for such steps. Therefore, there is a problem that the cost of the curl removing device further increases due to the above steps.

And however, in the above curl removing device 140, the shaft 143 used for forming the feeding path of the rolled paper 150 is inserted into the elliptical hole 142A formed in the bearing member 142, thus there occurs a problem that it inevitably produces a clearance between the shaft 143 inserted in the shaft catch member 148 and the bearing member 142. Based on the clearance, while the facsimile machine with the above curl removing device 140 is transported, collision between the iron shaft 143 and the bearing member 142 made of synthetic resin is repeated due to oscillation occurring while transportation. As a result, there is a problem that uncomfortable noise produces due to the clearance and the bearing member 142 is broken.

SUMMARY OF THE INVENTION

Accordingly, it is an object of the present invention to overcome the above mentioned problems and to provide a curl removing device in which the curl removing plate can be easily installed to the main body of the image forming apparatus, thereby assembling step and work thereof can be simplified and cost thereof can be reduced.

And it is another object of the present invention to provide a curl removing device in which parts used for assembling thereof can be reduced and assembling step thereof can be simplified, thereby cost thereof can be reduced.

Further, it is another object to provide a curl removing device in which a clearance between a rib for forming a feeding path of the rolled paper and a fluctuation member for removing the curl of the rolled paper can vanish, thereby uncomfortable noise due to the clearance can be avoided and it can prevent parts in the curl removing device from being broken.

To accomplish the above objects, the present invention provides a curl removing device for a rolled paper utilizable in an image forming apparatus, comprising:

a curl removing plate having a curl removing part straining the rolled paper in a direction opposite to a curl direction of the rolled paper and removing a curl in the rolled paper, a holding part continuously formed from the curl removing part with a predetermined angle and a pair of supporting parts formed at both sides of the holding part, each supporting part having a support hole;

a plate holding part formed in a main body of the image forming apparatus so as to rotatably support the curl removing plate, the plate holding part having a pair of supporting sections formed in the main body, each supporting section having a support shaft which is supported in the support hole of the supporting part from one direction and a flat plate part arranged opposite to the holding part;

a cutout portion formed in one of the holding part and the flat plate part; and a resilient member formed in the other of the holding part and the flat plate part, the resilient member being resiliently hooked in the cutout portion and positioning the curl removing plate against the flat plate part.

In the curl removing device, the cutout portion is formed in one of the holding part and the flat plate part and the resilient member is formed in the other of the holding part and the flat plate part, the resilient member being resiliently hooked in the cutout portion and positioning the curl removing plate against the flat plate part. Further, when the curl removing plate is set to the plate holding part, the holding part is slid on the flat plate part so that each support shaft is fit into the support hole from the one direction and the resilient member is hooked in the cutout portion. At this time, the resilient member acts for positioning the curl removing plate against the plate holding part, thereby it can prevent the curl removing plate from being taken off from the plate holding part.

Therefore, the curl removing plate can be easily set to the plate holding part formed in the main body of the image forming apparatus, and the curl removing device can be easily assembled with low cost by simplifying assembling steps thereof.

And according to another aspect of the present invention, it is provided a curl removing device for removing a curl of a rolled paper by bending the rolled paper in a direction opposite to a curl direction of the rolled paper, the curl removing device comprising:

a case having a tray for installing the rolled paper;

a fluctuation member supported to the case so as to be able to fluctuate, the fluctuation member partially forming a feeding path of the rolled paper;

a cover for covering the case, the cover being supported to the case so as to be able to open and close; and a feeding path forming rib formed in the cover, the feeding path forming rib bending the feeding path of the rolled paper in the direction opposite to the curl direction thereof in cooperation with the fluctuation member.

In the curl removing device, the feeding path of the rolled paper is partially bent in the direction opposite to the curl direction of the rolled paper by the fluctuation member supported to the case and the feeding path forming rib formed in the cover. Therefore, the rolled paper derived from the tray is bent in the direction opposite to the curl direction thereof while passing through the feeding path. As a result, the curl in the rolled paper is removed.

Thus, according to the curl removing device, since it is formed into one body with the cover the feeding path forming rib which partially constructs the feeding path of the rolled paper so as to bend the feeding path in the direction opposite to the curl direction, parts for the device can be reduced. Therefore, assembling of the cover to the case can be easily conducted and cost thereof can be reduced.

And according to further another aspect of the present invention, it is provided a curl removing device for removing a curl of a rolled paper by bending the rolled paper in a direction opposite to a curl direction of the rolled paper, the curl removing device comprising:

a case having a tray for installing the rolled paper;

a fluctuation member supported to the case so as to be able to fluctuate, the fluctuation member partially forming a feeding path of the rolled paper;

a cover for covering the case, the cover being supported to the case so as to be able to open and close;

guide ribs guiding the fluctuation member toward a predetermined position corresponding to closing operation of the cover, thereby the feeding path is formed when the fluctuation member is guided to the predetermined position;

a feeding path forming rib formed in the cover, the feeding path forming rib bending the feeding path of the rolled paper in the direction opposite to the curl direction thereof in cooperation with the fluctuation member; and a biasing member for biasing the fluctuation member toward the feeding path forming rib or the guide ribs.

In the curl removing device, when the cover is closed, the guide ribs formed in the cover act to the fluctuation member, thereby the fluctuation member is positioned to the predetermined position. Thus, the feeding path of the rolled paper is partially bent by the fluctuation member and the feeding path forming rib. And the rolled paper derived from the tray is bent in the direction opposite to the curl direction thereof while passing through the feeding path. As a result, the curl in the rolled paper is removed.

Here, the fluctuation member supported to the case is biased toward the feeding path forming rib or the guide ribs, therefore both the fluctuation member and the guide ribs are arranged at the predetermined positions without clearance therebetween. Thus, even if the curl removing device oscillates while transportation thereof, it can prevent uncomfortable noise from occurring and parts of the device from being broken.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the following drawings, wherein.

DETAILED DESCRIPTION OF THE PREFERRED EMBODIMENTS

A detailed description of the curl removing device according to the first embodiment of the present invention will be given with reference to the accompanying drawings. The curl removing device is utilized for a facsimile machine.

Figure 1:
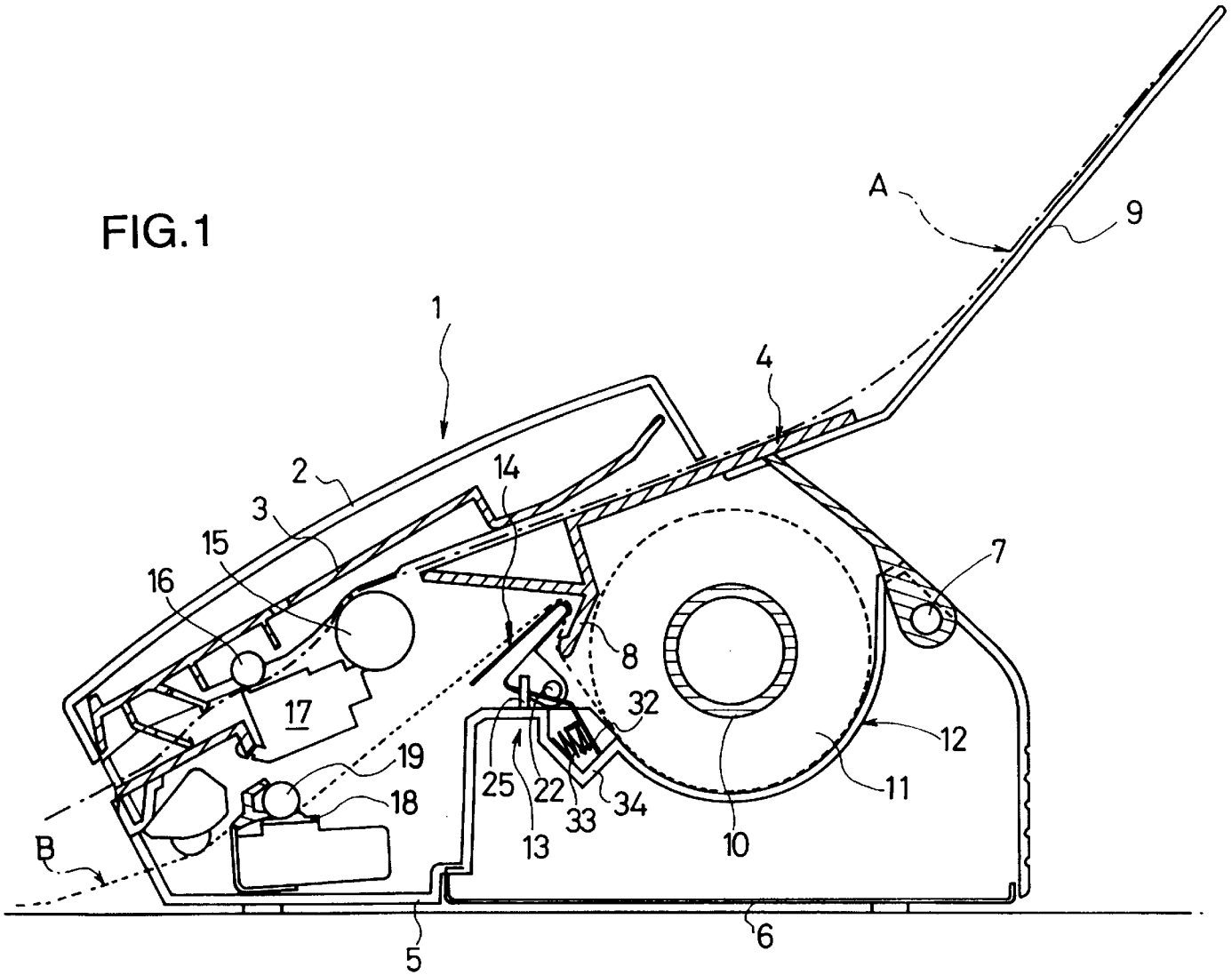
FIG. 1 is a sectional view of a facsimile machine according to the first embodiment of the present invention.

First, whole construction of the facsimile machine in which the curl removing device is utilized will be described according to FIG. 1. In FIG. 1, a main body of the facsimile machine 1 has an operation cover 2 on which it is arranged a keyswitch panel for inputting facsimile numbers and the like, an upper cover 3 fixed to the operation cover 2, a guide cover 4 arranged behind the upper cover 3 (in FIG. 1, the guide cover 4 is arranged in the right side) for guiding a manuscript, a lower cover 5 constructing a lower part of the facsimile machine 1 and a bottom plate 6 fixed to a bottom part of the lower cover 5.

Here, the guide cover 4 is rotatably supported at the rear end (the right end in FIG. 1) of the lower cover 5 so as to be able to rotate around a shaft 7, and at the front position of the guide cover 4, an auxiliary member 8 extended in the oblique lower direction is formed into one body with guide cover 4. In this auxiliary member 8, the lower end thereof has a circular arc shape and the auxiliary member 8 acts for straining the rolled paper 11 in the direction opposite to the curl direction thereof and for removing the curl in the rolled paper 11, in cooperation with a curl removing plate 14 (later mentioned). And at the right side of the guide cover 4, a guide plate 9 for supporting the manuscript is positioned. In the above construction, when the guide cover 4 is rotated in the clockwise direction around the shaft 7, the operation cover 2 and the upper cover 3 are rotated in the clockwise direction together with the guide cover 4. Further, at the rear position of the lower cover 5, it is formed a cylindrical tray 12 in which the rolled paper 11 wound around a cylindrical core 10 is rotatably set.

At the left position of the tray 12, a plate holding part 13 is formed in the lower cover 5 and the plate holding part 13 holds the curl removing plate 14 so as to be able to rotate. Here, it will be hereinafter described in detail both the construction and assembling relation of the plate holding part 13 and the curl removing plate 14.

Within the facsimile machine 1, a sending roller 15 for sending the manuscript is arranged downstream the guide cover 4 along a guide path A (indicated by dashed line in FIG. 1) of the manuscript which is sent into the main body through the guide plate 9 and the guide cover 4. And at the side downstream the sending roller 15, it is positioned an CCD reading head 17 which reads out the letters on the manuscript while depressed by a roller 16. Therefore, the manuscript supported on the guide plate 9 is sent along the guide path A through the sending roller 15, and while sending of the manuscript the letters thereon are read out by the CCD reading head 17.

And in the facsimile machine 1, a print mechanism is arranged under the CCD reading head 17. This print mechanism is constructed from a thermal head 18 and a platen roller 19. Thus, the rolled paper 11 set in the tray 12 is sent along a guide path B (indicated by dotted line in FIG. 1) by the platen roller 19 and the letters on the received document are printed on the rolled paper 11 by the thermal head 18 while the curl in the rolled paper 11 is removed by straining in the direction opposite to the curl direction thereof in cooperation with the auxiliary member 8 and the curl removing plate 14.

Figure 2:
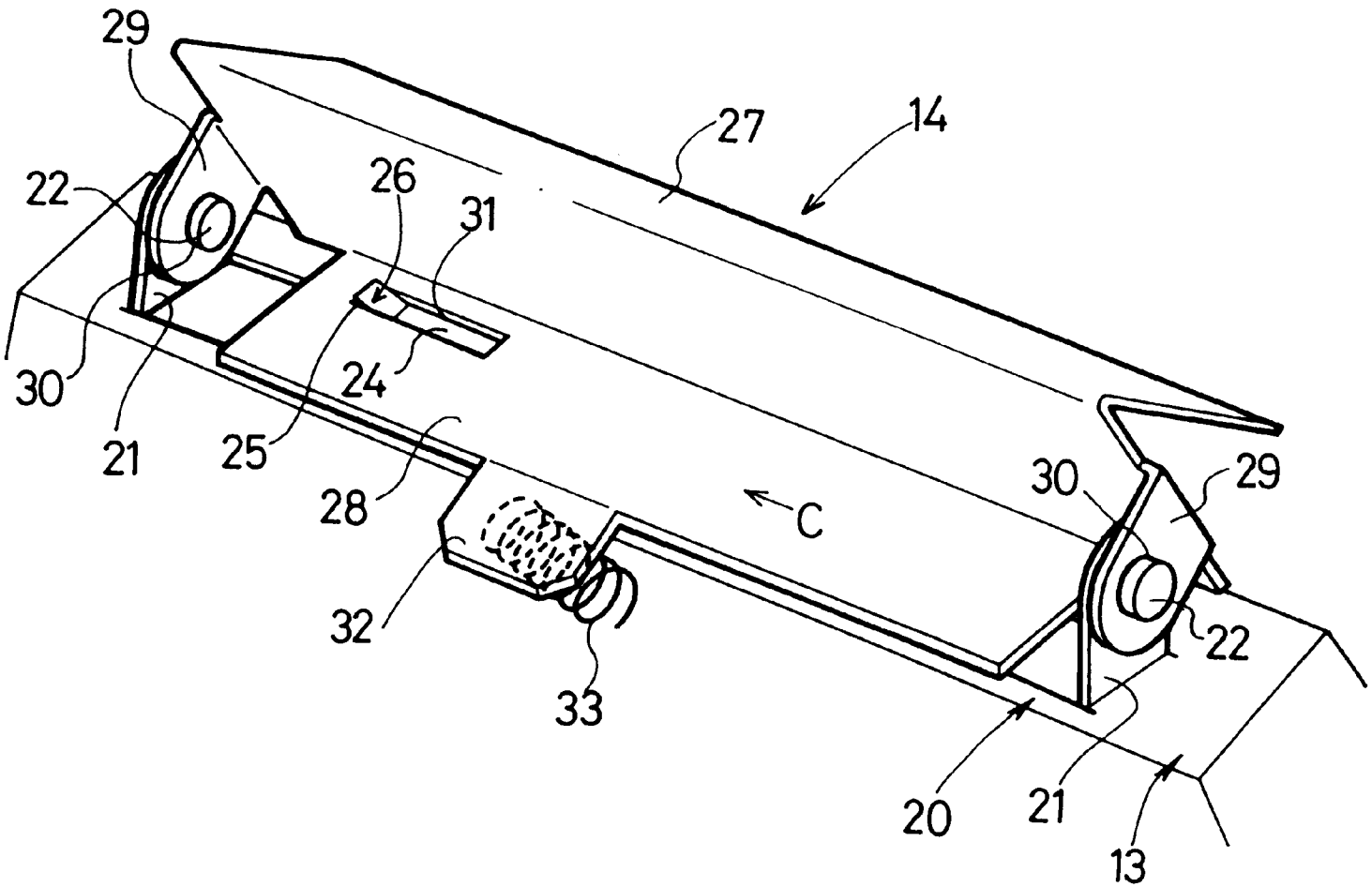
FIG. 2 is a perspective view showing a state that a curl removing plate is installed to a plate holding part.
Figure 3:
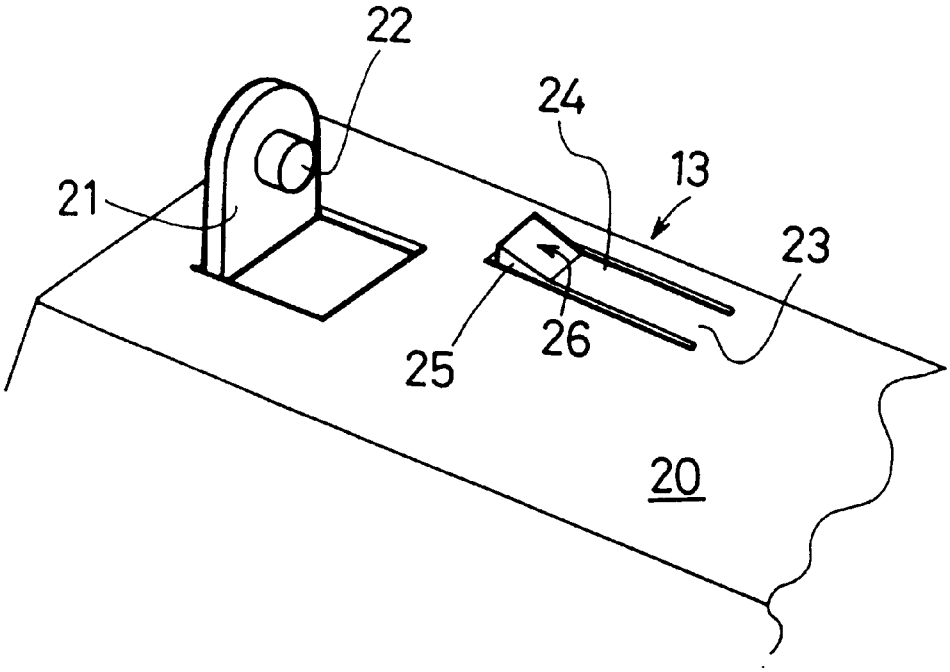
FIG. 3 is a perspective view partially showing the plate holding part which is enlarged.

Next, both detailed construction and assembling relation of the plate holding part 13 and the curl removing plate 14 will be described with reference to FIGS. 2 and 3. In FIGS. 2 and 3, the plate holding part 13 has a flat plate part 20 on which a pair of support sections 21 are formed at both sides in the long direction thereof. On one side (the right side in FIG. 2) of each support section 21, a support shaft 22 is formed. Further, at a position near one of the support sections 21 on the flat plate part 20, a resilient hook member 24 is formed. This resilient hook member 24 is formed by cutting the flat plate part 20 in a substantial rectangular shape while remaining a connecting portion 23 connected to the flat plate part 20. The resilient hook member 24 is resiliently movable in up and down directions by 42 making the connecting portion 23 act as the standard point of movement. In the resilient hook member 24, a projection 25 is formed at an opposite end to the connecting portion 23. On the projection 25, it is formed a inclined surface 26 which is positioned at the side (the right side of the projection 25 in FIGS. 2, 3) toward which the curl removing plate 14 is slid on the flat plate part 20.

The curl removing plate 14 is formed by folding a thin metal plate and has a curl removing part 27 and a holding part 28 continuously formed to the curl removing part 27, both the curl removing part 27 and the holding part 28 being formed into one body. From the both sides of the curl removing part 27, a pair of support parts 29 are formed so that the support parts 29 are positioned both sides of the holding part 28. In each support part 29, a support hole 30 is formed. In the holding part 28, a cutout portion 31 is formed corresponding to the resilient hook member 24 formed on the flat plate part 20 in the plate holding part 13. Here, it is formed from the side edge of the holding part 28 a spring support portion 32 on lower surface of which a coil spring 33 is supported. The coil spring 33 is received in a recess 34 formed in the lower cover 5 neighboring the plate holding part 13 as shown in FIG. 1 and acts for biasing the curl removing plate 14 in the anticlockwise direction under the condition that the curl removing plate 14 is rotatably supported through the support shafts 22 on the support sections 21. For example, in the state shown in FIG. 1, the curl removing plate 14 is slightly rotated in the clockwise direction against biasing force of the coil spring 33 based on the strain force of the rolled paper 11, since the rolled paper 11 is retained in the strained state by contacting with both the auxiliary member 8 and the curl removing part 27.

In addition to the above, in the curl removing device constructed above, it will be described assembling method to assemble the curl removing plate 14 to the plate holding part 13. First, the operation cover 2 with the guide cover 4 of the facsimile machine 1 and the upper cover 3 are rotated in the clockwise direction around the shaft 7, thereby the inner space of the main body is opened. In this state, each support part 29 of the curl removing plate 14 is positioned at the right side of each support section 21 in the flat plate part 20. And the holding part 28 of the curl removing plate 14 is slid in the direction shown by an arrow C on the flat plate part 20 and the support shafts 22 on the support sections 21 are inserted into the support holes 30 formed in the support parts 29. In this way, while the curl removing plate 14 is slid on the plate support part 13, the projection 25 on the resilient hook member 24 contacts with the back surface of the holding part 28 and is depressed downward. Thereby, the resilient hook member 24 is resiliently deformed downward (in the inner direction of the flat plate part 20). At that time, since the inclined surface 26 is formed on the projection 25, there is no problem in sliding of the holding part 28 on the flat plate part 20 and therefore the holding part 28 can be smoothly slid on the flat plate part 20. And at the time that the left end of the cutout portion 31 is ridden over the inclined surface 26 of the projection 25, the resilient hook member 24 returns to the original state based on its resilient force. Therefore, as shown in FIG. 2, the projection 25 hooks the holding part 28 under the condition that the left edge thereof contacts with the left edge of the cutout portion 31, and further the projection 25 acts for positioning the holding part 28 at the above position. Thus, the curl removing plate 14 is positioned against the plate holding part 13.

As mentioned in detail, according to the curl removing device of the first embodiment, the cutout portion 31 is formed on the holding part 28 of the curl removing plate 14 and it is formed in the plate holding part 13 the resilient hook member 24 which positions the curl removing plate 14 against the flat plate part 20 by being resiliently hooked to the cutout portion 31. And when the curl removing plate 14 is installed to the plate holding part 13, the curl removing plate 14 is slid on the flat plate part 20 so that the support shafts 22 of the support sections 21 are inserted in the support holes 30 of the support parts 29 in one direction (the direction shown by the arrow C) and the resilient hook member 24 is hooked to the cutout portion 31. Thereby, the resilient hook member 24 is resiliently hooked in the cutout portion 31 and acts for positioning the curl removing plate 14 against the flat plate part 20, as a result, there is no occurrence that the curl removing plate 14 is taken off from the plate holding part 13. Thus, the curl removing plate 14 can be easily installed to the plate holding part 13 formed within the main body of the facsimile machine 1 and assembling steps can be simplified, thereby assembling work of the curl removing device can be easily done with lower cost.

The resilient hook member 24 is formed by cutting in substantial rectangular shape under the condition that the connecting portion 23 continuously connected to the flat plate part 20 of the plate holding part 13 is remained. Therefore, it can be simply formed the resilient hook member 24 which acts for positioning the curl removing plate 14 against the plate holding part 13 in cooperation with the cutout portion 31, without necessitating particular members.

Further, since the projection 25 formed on the resilient hook member 24 is automatically hooked in the cutout portion 31 by only simply sliding the holding part 28 on the flat plate part 20, the curl removing plate 14 can be easily positioned against the plate holding part 13.

And since it is formed on the projection 25 the inclined surface 26 at one side toward which the holding part 28 of the curl removing plate 14 is slid on the flat plate part 20 of the plate holding part 13, the holding part 28 is slid along the inclined surface 26 of the projection 25 when the holding part 28 is slid on the flat plate part 20. Therefore, the projection 25 can be hooked in the cutout portion 31 while smoothly sliding the holding part 28 on the flat plate part 20.

Next, a curl removing device according to the second embodiment of the present invention will be described with reference to FIGS. 4–8. The curl removing device of the second embodiment is used in the facsimile machine in which the rolled paper is utilized as the print paper. And the curl removing device is mainly constructed from an upper cover 55 and a curl removing plate 57.

Figure 4:
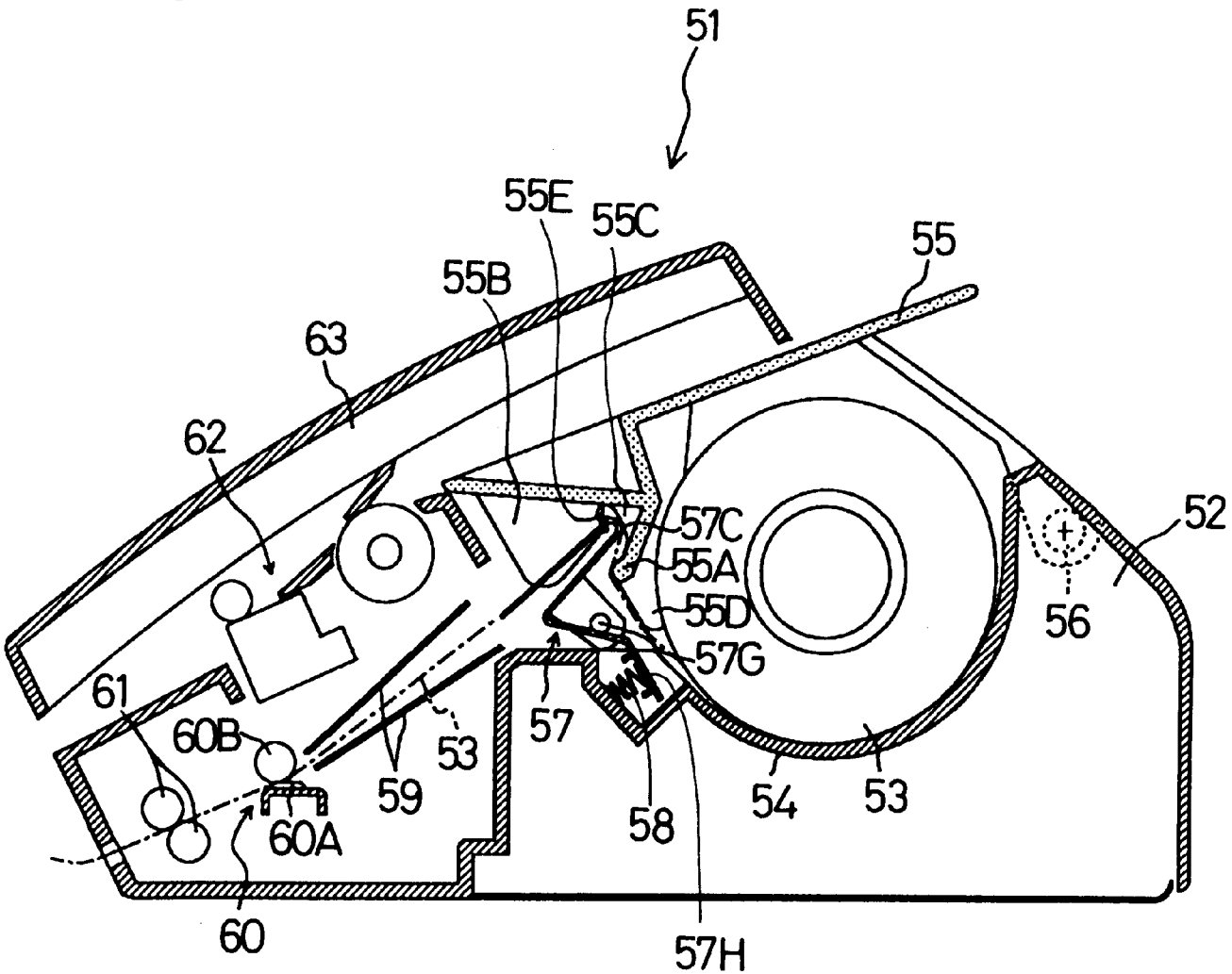
FIG. 4 is a sectional view of a facsimile machine according to the second embodiment of the present invention.

FIG. 4 is a side sectional view of the facsimile machine 51. In a case 52 of the facsimile machine 51, it is formed a tray 54 for receiving a rolled paper 53. Over the tray 54 it is arranged the upper cover 55 covering upper space of the rolled paper 53.

The upper cover 55 is rotatably supported to the case 52 through a support shaft 56. At the other end of the upper cover 55 (the right side in FIG. 4), it is formed a rib 55A which forms a part of a feeding path of the rolled paper 53 derived from the tray 54. This rib 55A is continuously formed in the upper cover 55 along a width direction of the rolled paper 53 and the width of the rib 55A is slightly longer than that of the rolled paper 53. At both sides of the rib 55A, a pair of first guide ribs 55B, a pair of second guide ribs 55C and a pair of third guide ribs 55D are formed in the width direction of the rolled paper 53 so that the rolled paper 53 derived from the tray 54 is held thereamong. Here, the upper case 55 is made of synthetic resin by injection mold and the rib 55A, the first guide ribs 55B, the second guide ribs 55C and the third guide ribs 55D are formed into one body with the upper cover 55.

As shown in FIG. 4, it is formed a groove portion 55E between the first guide rib 55B and the second guide rib 55C. In the groove portion 55E, the curl removing plate 57 made of thin metal plate is inserted. Both sides of the curl removing plate 57 are supported to the case 52 through a pair of shafts 57G so as to be able to fluctuate. The curl removing plate 57 acts for bending the feeding path of the rolled paper 53 in the direction opposite to the curl direction of the rolled paper 53. In the curl removing plate 57, a receiving plate 57H is formed at lower position thereof. As shown in FIG. 4, the receiving plate 57H is biased by a coil spring 58 in the anticlockwise direction around the shafts 57G, thereby the curl removing plate 57 is always biased toward the guide rib 55B by the coil spring 58.

Figure 5:
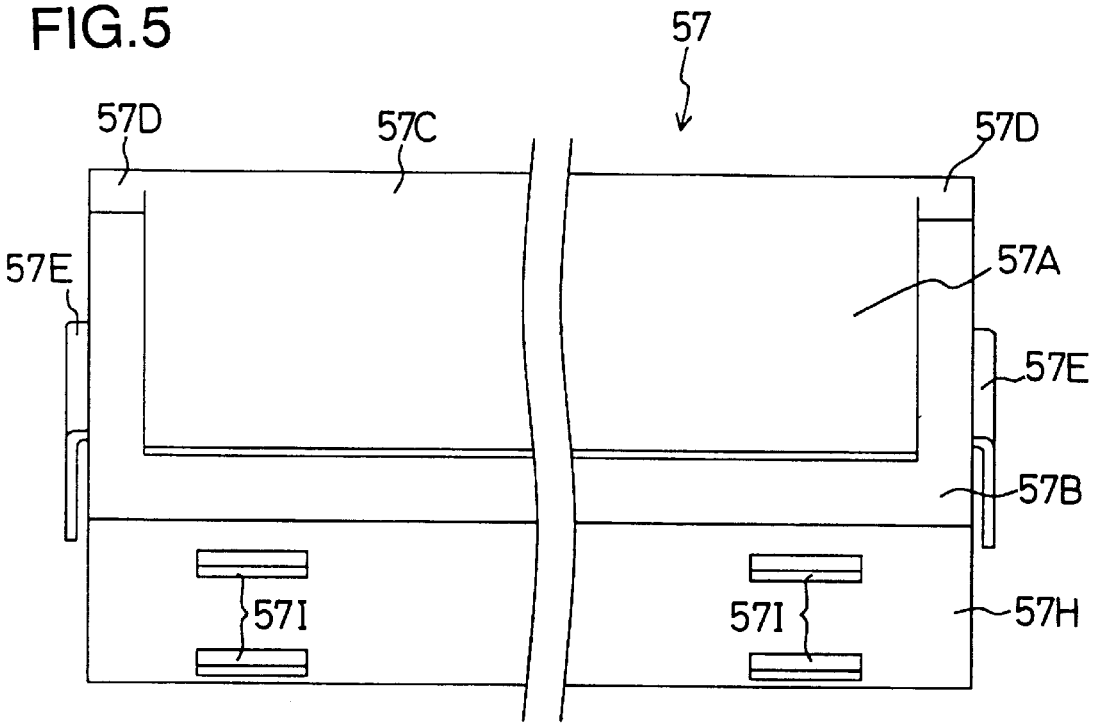
FIG. 5 is a front view of the curl removing plate.
Figure 6:
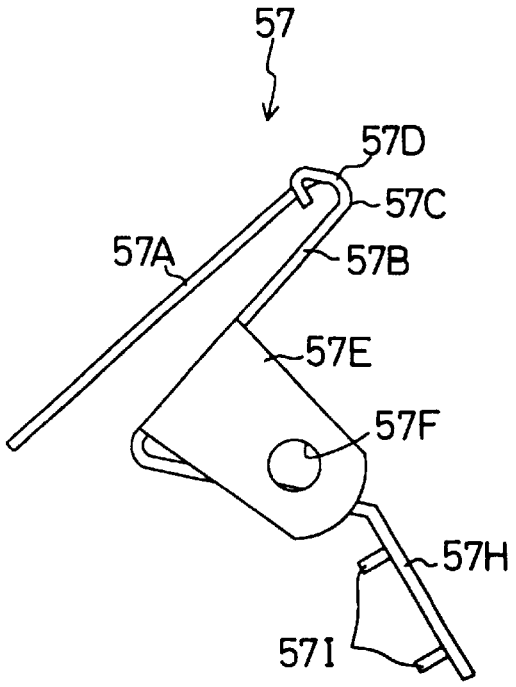
FIG. 6 is a side view of the curl removing plate.

Here, it will be described in detail the curl removing plate 57 with reference to FIGS. 5 and 6. Here, FIG. 5 is a front view of the curl removing plate 57 and FIG. 6 is a side view thereof. In FIGS. 5 and 6, the curl removing plate 57 is mainly constructed from an upper plate 57A having flat plate shape, a lower plate 57B having flat plate shape formed at lower position of the upper plate 57A and the receiving plate 57H continuously connected to the lower plate 57B. The upper plate 57A and the lower plate 57B are bent in a substantial "U" shape at a bending portion 57C, and the bending portion 57C and the upper plate 57A construct a part of the feeding path of the rolled paper 53. Thus, the widths of the upper plate 57A and the bending portion 57C are formed so as to be longer than that of the rolled paper 53.

As shown in FIG. 4, top end of the bending portion 57C and top end of the rib 55A are mutually opposed in a substantial "S" shape, thereby bending in the direction opposite to the curl direction of the rolled paper 53 is formed in the feeding path. When the rolled paper 53 passes in the bent feeding path, the curl of the rolled paper 53 is removed.

In FIGS. 5 and 6, a pair of guide portions 57D are formed at both sides of the bending portion 57C. Portion between the guide portion 57D, the upper plate 57A and the bending portion 57C is cut and the top end of the guide portion 57D is bent toward the lower plate 57B. The guide portion 57D is slidably contacted with the first guide rib 55B, the second guide rib 55C and the third guide rib 55D of the upper cover 55. When the upper cover 55 is rotated around the shaft 56 so as to cover the case 52, the guide portion 57D is first contacted with one of the guide ribs 57B, 57C and 57D and thereafter slid along the guide rib 55B, 55C or 55D contacted. The guide portion 57D is finally guided and inserted into the groove portion 55E positioned between the first guide rib 55B and the second guide rib 55C. Based on this movement of the guide portion 57D, the curl removing plate 57 is set to the predetermined position shown in FIG. 4.

At both sides of the lower plate 57B in the curl removing plate 57, a pair of side plates 57E, each having a shaft hole 57F, are formed. In the shaft holes 57F of the side plates 57E, shafts such as screws are inserted and the curl removing plate 57 is arranged to the case 52 by fastening the shafts (screws) to the case 52. The shafts act as the shafts 57G.

In the lower plate 57B, the receiving plate 57H is formed which is contacted with the coil spring 58. In this receiving plate 57H, two pairs of spring receiving portions 57I are formed. In the pair of spring receiving portions 57I, two portions 57I are horizontally arranged. The coil spring 58 connected with the receiving plate 57H is set between the spring receiving portions 57I so that contact position is not slipped.

In FIG. 4, a pair of guides 59 are arranged downstream the curl removing plate 57. These guides 59 are used for sending the rolled paper 53 from the upper plate 57A to a print part 60. The print part 60 to which the rolled paper 53 is set through the guides 59 has a print head 60A such as a thermal print head and a platen 60B acting as a sending roller. The print part 60 conducts printing of letters, etc. on the rolled paper 53 (heatsensitive print paper) through the print head 60A in which heat elements are selectively heated. Downstream the print part 60A a pair of sending rollers 61 are arranged. After printing is conducted by the print part 60, the rolled paper 53 is sent at a predetermined speed by rotation of the sending rollers 61. Thereafter, the rolled paper 53 is discharged out of the facsimile machine 51 through the sending rollers 61.

At upper position of the print part 60 and the guides 59, it is arranged a scanner device 62 for reading out images on the manuscript inserted along the upper over 55. Upper position of the scanner device 62 is covered by a panel cover 63 which is rotatably supported to the case 52. A rotating shaft (not shown) is arranged at one end of the panel cover 63. On the upper surface of the panel cover 63, an operation panel having a plurality of switching buttons and a liquid crystal display displaying operation state, etc. of the facsimile machine 51 are positioned. When buttons on the operation panel are depressed, the facsimile machine 51 is variously operated.

Figure 7:
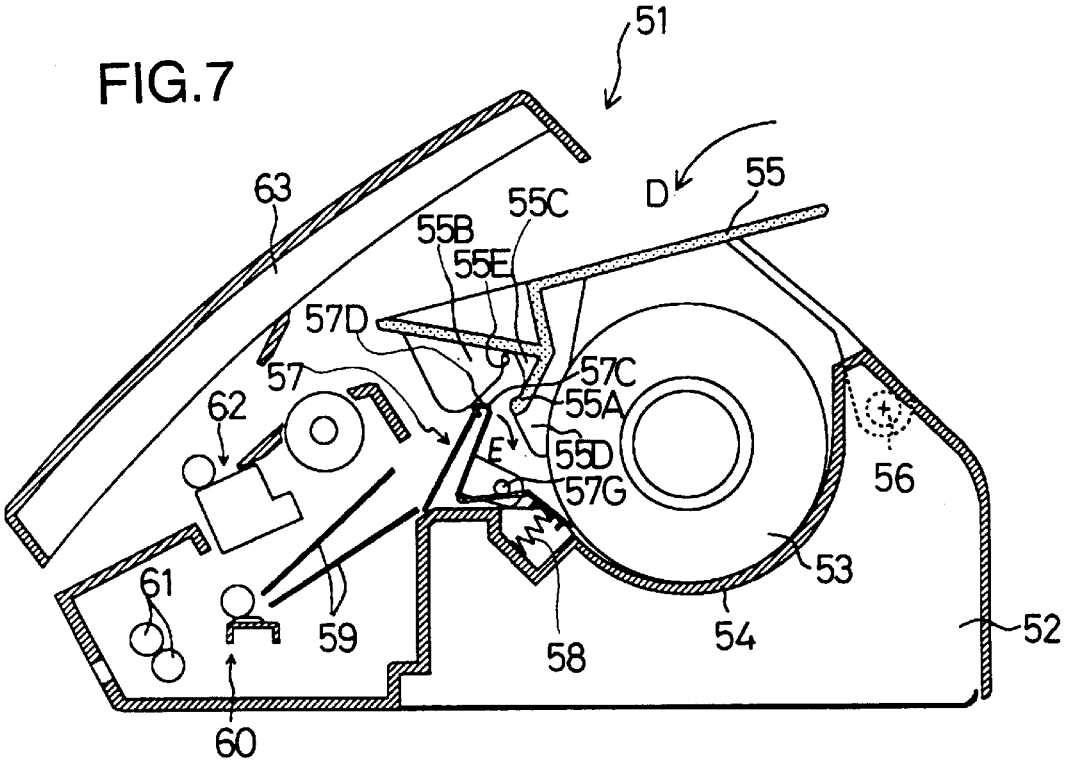
FIG. 7 is a side sectional view which indicates a state that the curl removing plate is moved to a predetermined position while an upper cover is rotated and closed.
Figure 8:
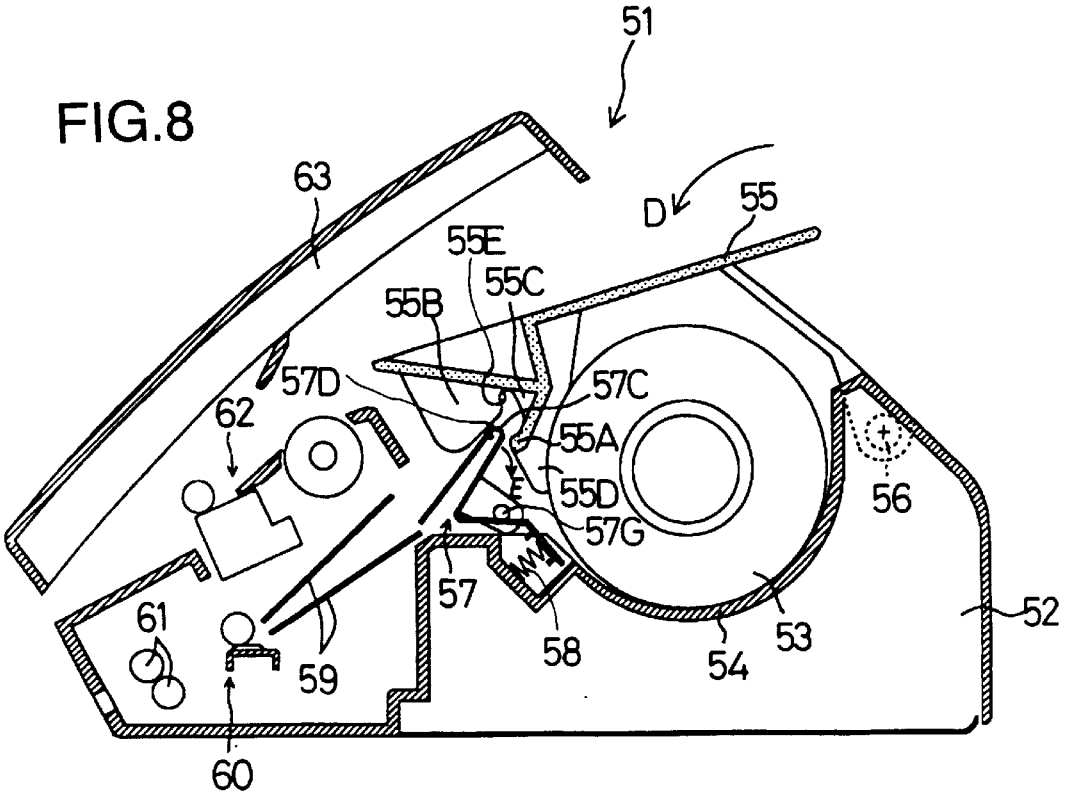
FIG. 8 is a side sectional view which indicates a state that the upper cover is further rotated from the state shown in FIG. 7.
Figure 9:
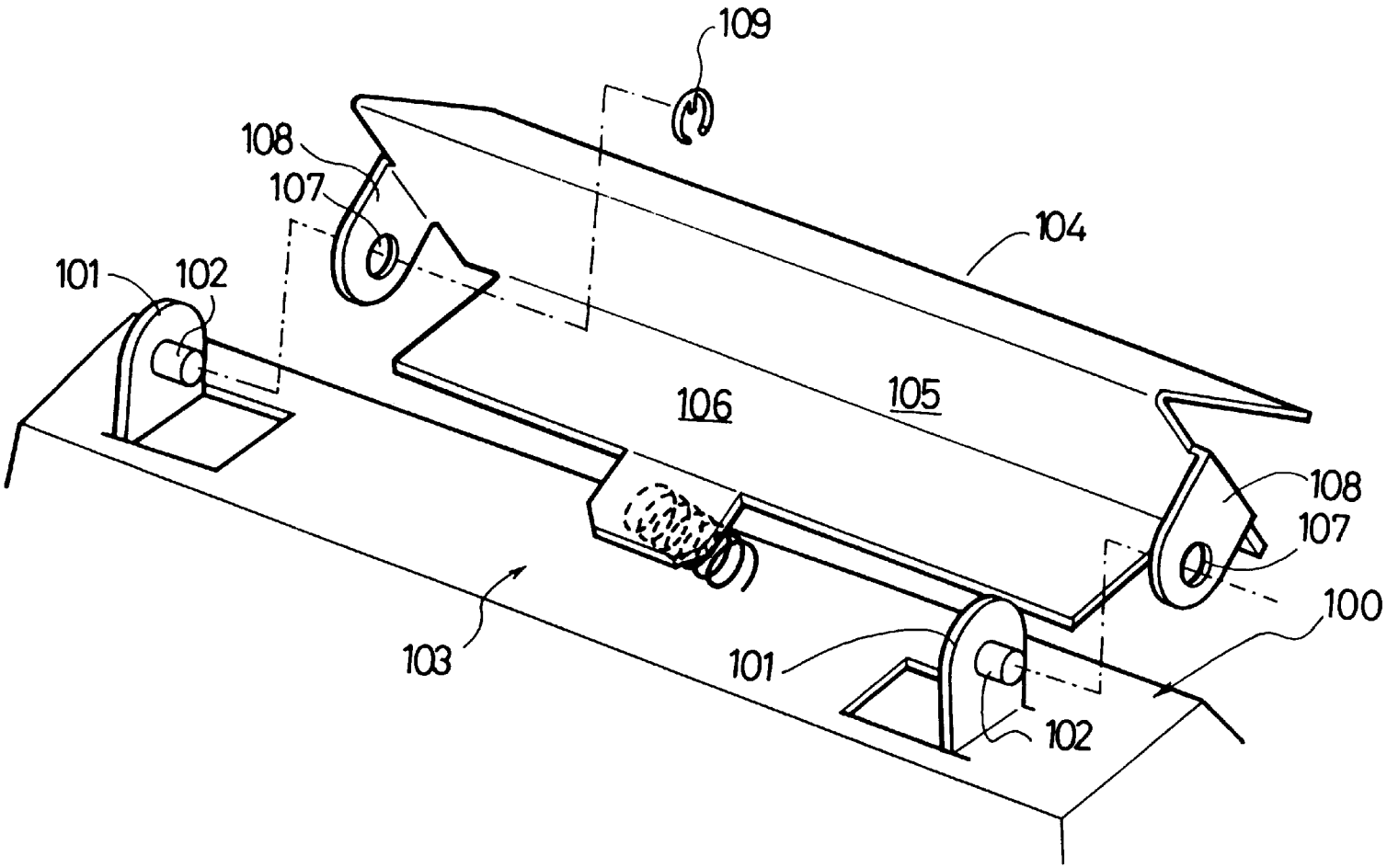
FIG.9 PRIOR ART
FIG. 9 is a perspective view schematically showing a relation between the curl removing plate and the plate holding part in the conventional curl removing device.
Figure 10:
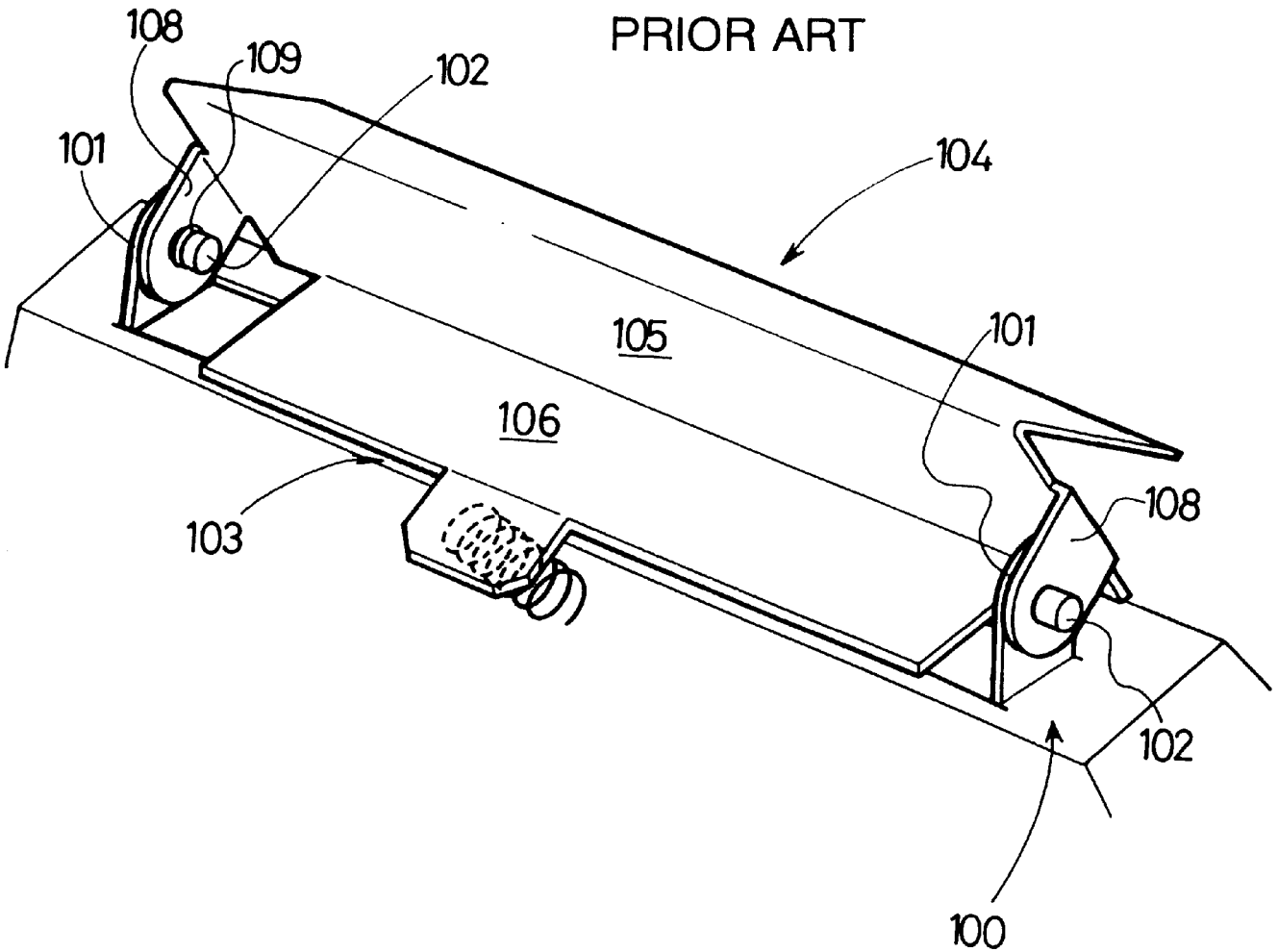
FIG.10 PRIOR ART
FIG. 10 is a perspective view schematically showing a state that the curl removing plate is assembled to the plate holding part in the conventional curl removing device.
Figure 11:
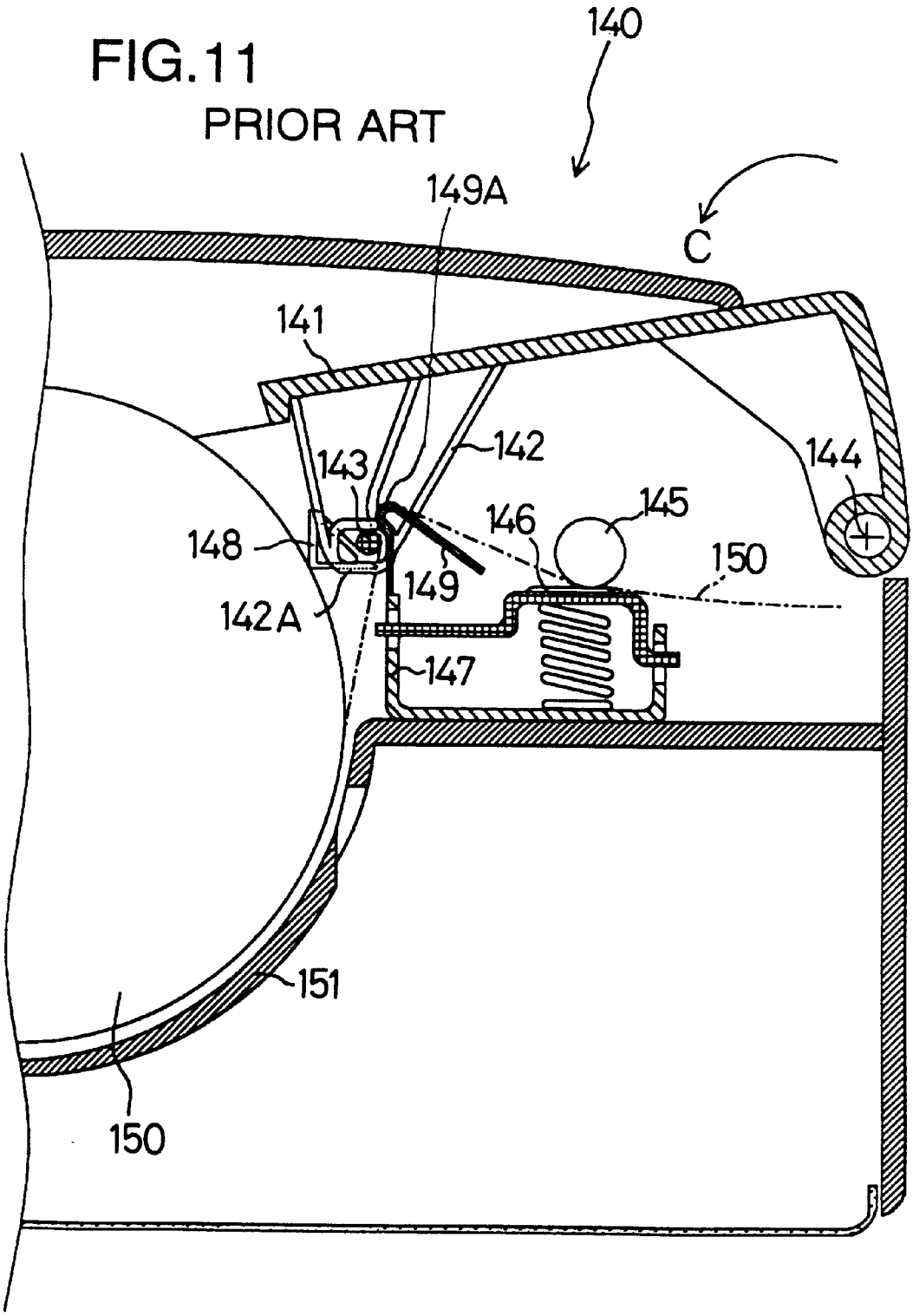
FIG.11 PRIOR ART
FIG. 11 is a side sectional view partially showing the curl removing device in the conventional curl removing device.

Next, it will be described procedure through which the feeding path bent in the direction opposite to the curl direction of the rolled paper 53 is formed in the facsimile machine 51, with reference to FIGS. 7 and 8. The feeding path is formed by the bending portion 57C of the curl removing plate 57 and the rib 55A of the upper cover 55 when the opened upper cover 55 is rotated in the direction shown by an arrow D. Here, FIGS. 7 and 8 shows state that the upper cover 55 is serially rotated and such state is changed from FIG. 7 to FIG. 8 according to rotation of the upper cover 55. Further, the state in which the upper cover 55 is completely closed is shown in FIG. 4.

When the upper cover 55 is rotated in the direction shown by the arrow D around the shaft 56, the guide portion 57D of the curl removing plate 57 is contacted with the first guide rib 55B of the upper cover 55, as shown in FIG. 7, since the curl removing plate 57 is biased in the direction opposite to the direction shown by an arrow E by the coil spring 58. Further, if rotation of the upper over 55 is continued after the guide portion 57D is contacted with the first guide rib 55B, the guide portion 57D is slid along the first guide rib 55B. Based on this sliding, the curl removing plate 57 is fluctuated in the direction shown by the arrow E around the shafts 57G. In case that fluctuation of the guide portion 57D is further continued, the guide portion 57D is gradually guided toward the groove portion 55E formed between the first guide rib 55B and the second guide rib 55C after passing the state shown in FIG. 8. Thereafter, the guide portion 57D is inserted into the groove portion 55E. This state is shown in FIG. 4.

Here, the groove portion 55E is shaped so as to correspond to the shape of the guide portion 57D and the curl removing plate 57 is biased toward the first guide rib 55B by the coil spring 58, thereby the upper cover 55 and the curl removing plate 57 are mutually locked without clearance therebetween, based on that the guide portion 57D is inserted into the groove portion 55E.

As mentioned above, based on that the guide portion 57D of the curl removing plate 57 is guided toward and inserted into the groove portion 55E, top end of the bending portion 57C in the curl removing plate 57 is opposed to the upper position of top end of the rib 55A after going over the rib 55A. In this way, top end of the bending portion 57C and the top end of the rib 55A are mutually opposed, thus when the bending portion 57C goes over the rib 55A and both are mutually opposed, the feeding path having substantial "S" shape in side view is formed. That is, the feeding path bent in the direction opposite to the curl direction of the roller paper 53 is formed by only closing the upper cover 55.

By the way, supposed that the curl removing plate 57 is arranged under inclined state toward the direction shown by the arrow E in FIG. 7, the guide portion 57D of the curl removing plate 57 is contacted with the third guide rib 55D of the upper cover 55 by rotating the upper cover 55. And if rotation of the upper cover 55 is continued after above contacting, the guide portion 57D is slid so as to be raised along the third guide rib 55D. While sliding the curl removing plate 57 is fluctuated in the direction shown by the arrow E around the shafts 57G.

When the guide portion 57D is further continued to slide, the guide portion 57D is guided to the second guide rib 55C after going over the rib 55A from the third guide rib 55D. And the guide portion 57D is further guided toward the groove portion 55E formed between the first guide rib 55B and the second guide rib 55C, as shown in FIG. 4, and the guide portion 57D is finally inserted into the groove portion 55E.

As mentioned, even if the guide portion 57D of the curl removing plate 57 is contacted with any one of the guide ribs 55B, 55C, 55D through the each of guide ribs 55B, 55C, 55D formed in the upper cover 55, the curl removing plate 57 can be certainly guided to the predetermined position. Therefore, it can be formed the feeding path bent in the direction opposite to the curl direction of the rolled paper 53 through cooperation with the bending portion 57C of the curl removing plate 57 and the rib 55A by only closing the upper cover 55. When the rolled paper 53 passes the feeding path, the rolled paper 53 is bent in the direction opposite to the curl direction thereof, thereby the curl is removed.

As mentioned above, according to the curl removing device of the second embodiment, since the curl removing device is mainly constructed by arranging both the upper cover 55 and the curl removing plate 57 to the case 52, assembling steps can be simplified. And the curl removing plate 57 is certainly arranged to the predetermined position according to closing of the upper cover 55 through the guide ribs 55B, 55C, 55D, even if arranging position of the curl removing plate 57 is slightly shifted from the predetermined position. Therefore, it is not required high preciseness when the curl removing plate 57 is set, as a result, assembling steps can be simplified. Further, the curl removing device can be assembled from less parts and can be easily assembled, thus cost thereof can be reduced.

And the curl removing plate 57 is moved to the predetermined position based on that both side edges thereof are guided by the each guide rib 55B, 55C, 55D, thereby the curl removing plate 57 is wholly precisely set to the predetermined position. As a result, if the rolled paper 53 orthogonally sent against the width direction of the curl removing plate 57 has a long width, the curl of the rolled paper 53 can be removed over the whole area in the width direction.

Further, in the curl removing device, since the curl removing plate 57 is biased toward the upper cover 55 by the coil spring 58, both the upper cover 55 and the curl removing plate 57 can be easily set without clearance therebetween. Therefore, if oscillation occurs while the facsimile machine 1 with the curl removing device is transported, uncomfortable noise due to the clearance can be avoided and it can prevent the parts from being broken.

And since biasing direction of the curl removing plate 57 by the coil spring 58 coincides with the feeding direction of the rolled paper 53, biasing force of the coil spring 58 is not reduced when the rolled paper 53 is fed, therefore the curl removing plate 57 can be certainly biased toward the guide rib 55B.

Further, the upper cover 55 is locked based on that the curl removing plate 57 is inserted into the groove portion 55E. That is, since the curl removing plate 57 acts as a lock member with the coil spring 58 for the upper cover 55, it can prevent the upper cover 55 from being unnecessarily taken off.

And since the curl removing device has a simple construction that the rib 55A and the guide rib 55B are formed in the upper cover 55 into one body and the curl removing plate 57 is fit to the upper cover 55, assembling parts can be reduced and assembling steps can be simplified. Thus, cost thereof can be reduced.

While the invention has been particularly shown and described with reference to preferred embodiments thereof, it will be understood by those skilled in the art that the foregoing and other changes in form and details can be made therein without departing from the spirit and scope of the invention.

For example, in the first embodiment, though the cutout portion 31 is formed in the holding part 28 of the curl removing plate 14 and the resilient hook member 24 is formed in the flat plate part 20 of the plate holding part 13, it is conceivable that the resilient hook member 24 is formed in the holding part 28 and the cutout portion 31 is formed in the flat plate part 20. In this case, the same effects can be obtained.

And in the second embodiment, though the rib 55A and the guide ribs 55B, 55C, 55D are formed in the upper cover 55, it is conceivable that all of or a part of the rib 55A and the guide ribs 55B, 55C, 55D can be separately formed from the upper cover 55. In this case, each rib 55A–55D separately formed is fixed in advance to the upper cover 55 by screws or adhesive before assembling thereof. If the each rib separately formed is fixed to the upper cover 55 before assembling, the upper cover 55 can be easily assembled.

Further in the second embodiment, though the guide rib 55B is formed at one side (the left side in FIG. 4) of the curl removing plate 57, it is conceivable that the guide rib 55B is formed at the other side (the right side) or both sides of the curl removing plate 57. In case that the guide rib 55B is formed at the other side (the right side in FIG. 4), the coil spring 58 is changed to a pull spring so that the curl removing plate 57 is biased in the clockwise direction (the direction shown by the arrow E). On the other hand, if the guide rib 55B is formed at both sides, the curl removing plate 57 may be biased in any direction by the coil spring or the pull spring.

What is claimed is:

1. A curl removing device for removing a curl of a rolled paper by bending the rolled paper in a direction opposite to a curl direction of the rolled paper, the curl removing device comprising:

a case having a tray for installing the rolled paper;

a fluctuation member supported on the case so as to be able to fluctuate, the fluctuation member partially forming a feeding path of the rolled paper;

a cover for covering the case, the cover being supported on the case so as to be able to open and close; and a feeding path forming rib formed in the cover, the feeding path forming rib forming the feeding path of the rolled paper in the direction opposite to the curl direction of the rolled paper in cooperation with the fluctuation member; and guide ribs formed in the cover, the guide ribs structured to contact and guide the fluctuation member toward a predetermined position corresponding to closing operation of the cover, thereby the feeding path is formed when the fluctuation member is guided to the predetermined position.

2. The curl removing device according to claim 1, wherein the guide ribs include at least a pair of first guide ribs, a pair of second guide ribs and a pair of third guide ribs.

3. The curl removing device according to claim 2, wherein the pairs of the first, the second and the third guide ribs are formed in the cover so as to contact with both sides of the fluctuation member.

4. The curl removing device according to claim 3, wherein the fluctuation member comprises a curl removing plate which is supported in the case so as to be able to fluctuate.

5. The curl removing device according to claim 4, wherein the curl removing plate is made of a thin metal plate.

6. The curl removing device according to claim 4, wherein a groove portion is formed between the pair of first guide ribs and the pair of second guide ribs and both sides of the curl removing plate are inserted in the groove portion.

7. The curl removing device according to claim 6, wherein the curl removing plate includes a bending portion having a top end which is opposed to a top end of the feeding path forming rib so as to form the feeding path with "S" shape.

8. The curl removing device according to claim 1, wherein the feeding path forming rib is continuously formed in a width direction of the rolled paper.

9. The curl removing device according to claim 8, wherein the feeding path forming rib has a width longer than the width of the rolled paper.

10. A curl removing device for removing a curl of a rolled paper by bending the rolled paper in a direction opposite to a curl direction of the rolled paper, the curl removing device comprising:

a case having a tray for installing the rolled paper;

a fluctuation member supported to the case so as to be able to fluctuate, the fluctuation member partially forming a feeding path of the rolled paper;

a cover for covering the case, the cover being supported on the case so as to be able to open and close;

guide ribs structured to contact and guide the fluctuation member toward a predetermined position corresponding to closing operation of the cover, thereby the feeding path is formed when the fluctuation member is guided to the predetermined position;

a feeding path forming rib formed in the cover, the feeding path forming rib forming the feeding path of the rolled paper in the direction opposite to the curl direction of the rolled paper in cooperation with the fluctuation member; and a biasing member for biasing the fluctuation member toward the feeding path forming rib and the guide ribs.

11. The curl removing device according to claim 10, wherein the fluctuation member is biased toward a feeding direction of the rolled paper in the feeding path by the biasing member.

12. The curl removing device according to claim 11, wherein the biasing member comprises a coil spring.

13. The curl removing device according to claim 12, wherein the fluctuation member comprises a curl removing plate which is supported in the case so as to be able to fluctuate.

14. The curl removing device according to claim 13, wherein the curl removing plate has a receiving plate at a lower end of the curl removing plate and the coil spring is installed between the receiving plate and the case.

15. The curl removing device according to claim 14, wherein the receiving plate has positioning part for positioning the coil spring on the receiving plate.

16. A curl removing device for removing a curl of a rolled paper by bending the rolled paper in a direction opposite to a curl direction of the rolled paper, the curl removing device comprising:

a case having a tray for installing the rolled paper;

a fluctuation member supported on the case so as to be able to fluctuate;

a cover for covering the case, the cover being supported on the case so as to be able to open and close; and a feeding path forming rib formed into one body with the cover, the feeding path forming rib forming a feeding path of the rolled paper in the direction opposite to the curl direction of the rolled paper in cooperation with the fluctuation member.

* * * * *